United States Patent [19]

Story

[11] Patent Number: 4,785,566

[45] Date of Patent: Nov. 22, 1988

[54] BULLET LUBRICATOR DEVICE

[76] Inventor: James W. Story, R.R. #4, Box 218, Wabash, Ind. 46992

[21] Appl. No.: 96,596

[22] Filed: Sep. 14, 1987

[51] Int. Cl.[4] ..... F41C 27/00

[52] U.S. Cl. ..... 42/90; 86/19

[58] Field of Search ..... 42/90; 86/19

[56] References Cited

U.S. PATENT DOCUMENTS

| | | | |
|---|---|---|---|
| 2,403,032 | 7/1946 | Stevens, Jr. | 86/19 |
| 4,108,044 | 8/1978 | Brown | 86/19 |
| 4,205,475 | 6/1980 | Wilson | 42/90 |
| 4,254,572 | 3/1981 | Nelson | 42/90 |
| 4,353,282 | 10/1982 | Holt | 42/90 |
| 4,384,424 | 5/1983 | Fowler | 42/90 |
| 4,393,613 | 7/1983 | Knosky | 42/90 |
| 4,411,088 | 10/1983 | Wilson | 42/90 |
| 4,414,770 | 11/1983 | Brinton, Sr. | 42/90 |
| 4,434,571 | 3/1984 | Eisenhuth | 42/90 |
| 4,533,019 | 8/1985 | Leding | 42/90 |

*Primary Examiner*—Charles T. Jordan

*Attorney, Agent, or Firm*—George Pappas

[57] ABSTRACT

A bullet lubricator device including a grease-holding cylinder defining a bore open at opposite ends, a bullet-holding cylinder defining a chamber open at opposite ends and attached to the grease-holding cylinder with its chamber in flow communication with one end of the bore, and as plunger being received for reciprocal movement within the grease-holding cylinder bore. Closures, actuatable between opened and closed positions, are hingedly mounted on opposite ends of the bullet-holding cylinder chamber. The bullet-holding cylinder is oriented perpendicular to the grease-holding cylinder bore and can receive a bullet of a given caliber or a size-reducing sleeve which adapts the chamber to accommodate a smaller caliber bullet. The grease-holding cylinder bore holds grease therein between a leading end portion of the plunger and the one end of the grease-holding cylinder. A trailing end portion of the plunger forms a handle adapted to be gripped by a user's hand to move the plunger relative to the grease-holding cylinder by pushing grease from the grease-holding cylinder bore through its one end into the bullet-holding cylinder chamber and about the bullet therein. O-rings are fitted about the plunger leading end portion and frictionally engage the grease-holding cylinder bore for wiping grease from the bore surface to prevent backflow of grease past the plunger leading end.

23 Claims, 2 Drawing Sheets

BULLET LUBRICATOR DEVICE

BACKGROUND OF THE INVENTION

1. Field of the Invention

The present invention generally relates to lubrication of bullets for muzzle-loading rifles and, more particularly, is concerned with a bullet lubricator device being operable to effectively apply a lubricating grease around a bullet without soiling the hands and rifle of the user.

2. Description of the Prior Art

With respect to muzzle-loading rifles, it is well known that greater accuracy and range can be achieved on a consistent basis if the lead bullet to be fired has been lubricated prior to loading. Lubricating the bullet with a suitable grease, such as mink oil, also resists build-up of lead from the bullet in the spiral grooves or rifling of the barrel due to metal-to-metal contact between the lead bullet and the bore of the metal rifle barrel. Lead build-up in the rifle barrel will subsequently interfere with the firing of bullets.

Typically, a muzzle loading rifle bullet is in the form of a solid body having an overall cylindrical configuration with a conical forward nose section. The solid bullet body has a circumferential, axially-interrupted, bearing surface provided by a forward band, a middle band and a rearward base being spaced-apart and defined on the exterior of the body with forward and rearward annular channels formed therebetween. The forward bearing band is ordinarily several thousandths of an inch larger than the bore diameter of the rifle barrel and is graved to the barrel rifling upon loading into the barrel bore so that the bullet will rotate as it travels down the bore upon firing. On the other hand, the middle band and the base of the bullet are ordinarily a thousandth of an inch less than the bore diameter. The annular forward and rearward channels are provided to receive and hold the lubricating grease.

When the muzzle-loading rifle is fired, the powder charge located upstream of the bullet ignites and forces the bullet at its base in the forward direction down the barrel bore which causes compression of the bullet's overall length and thereby expansion and upsetting of the lead metal of the base and middle band of the bullet outwardly and forwardly into the grease-holding channels. The lubricating grease in the channels is then forced radially outward to provide proper lubrication of the exterior bearing surface of the bullet as it is fired from the rifle barrel.

Filling the annular channels of the bullet with lubricating grease by using one's bare hands is a messy operation and, during cold weather, is uncomfortable also. Furthermore, an uneven or insufficient amount of grease is oftentimes applied. A variety of different devices have been proposed in the prior art to obviate the necessity to use one's bare hands. Representative of the prior patent art are the devices disclosed in U.S. Pat. Nos. to Nelson (4,254,572), Holt (4,353,282), Fowler (4,384,424), Knosky (4,393,613), Brinton, Sr. (4,414,770), Eisenhuth (4,434,571) and Leding (4,533,019). While many devices of the prior art would appear to operate reasonably well and generally achieve their objectives under the limited range of operating conditions for which they were designed, most seem to embody shortcomings which make them less than an optimum device for effectively applying lubricating grease to the bullet. One shortcoming is that a separate storage container is required to be used with many of the devices to supply the lubricating grease needed each time a bullet is to be lubricated. Another shortcoming is that most of the devices cannot be closed or sealed against contamination by dirt and other foreign matter, especially during periods of nonuse. Still another shortcoming is that in many of the devices the grease can flow to places on the device where it will be exposed to and thus soil the hands and clothes of the user if not wiped off after each use.

Consequently, a need still exists for a bullet lubricator device which is easy to set up and use, can be used with gloves on the user's hands, is relatively simple in construction and operation, is sealed against contamination by dirt and other foreign matter, and minimizes the possibility of soiling one's hands and clothes and the rifle.

SUMMARY OF THE INVENTION

The present invention provides a bullet lubricator device designed to satisfy the aforementioned needs. The bullet lubricator device of the present invention basically includes a grease-holding cylinder connected in flow communication with a bullet-holding cylinder. The device also includes an elongated plunger reciprocally mounted within the grease-holding cylinder for feeding grease by pushing the plunger into the bullet-holding cylinder. About the leading end portion of the plunger there is mounted at least one 0-ring to prevent backflow of grease past the plunger and from the rear of the grease-holding cylinder adjacent to a knurled handle formed on the plunger. The bullet-holding cylinder is adapted to accommodate different caliber bullets by providing one or more size-reducing sleeves which individually fit into the bullet-holding cylinder of the device. The bullet-holding cylinder of the device can have hinged closures which are opened during loading and withdrawal of a bullet and closed when the device is operated to apply grease to a bullet and then stored in the user's pocket until needed. With such constructional features, it is readily seen that the bullet lubricator device of the present invention provides a slender, compact tool to apply grease about a bullet and which is cleaner and faster than using one's fingers alone, more efficient than most, if not all, of the prior art devices, and easily stored in the user's pocket during periods of nonuse.

Accordingly, the present invention is directed to a bullet lubricator device including a grease-holding tubular member defining a bore open at opposite ends of the member, a bullet-holding member being connected in flow communication with one of the opposite ends of the grease-holding member and defining a chamber open at opposite ends of the member and adapted to receive a bullet of a given caliber therein and, a plunger received within the grease-holding member bore and capable of reciprocal movement therein. The plunger has opposite leading and trailing end portions, with the leading end portion being disposed within the grease-holding member bore between the opposite ends thereof and the trailing end portion being disposed outside of the bore adjacent to the other of the opposite ends thereof. The grease-holding member bore is adapted to hold a quantity of grease therein between the leading end portion of the plunger and the one of the opposite ends of the grease-holding member. The plunger trailing end portion forms a handle adapted to be gripped by a user's hand for moving the plunger relative to the grease-holding member to advance the leading end portion of the plunger toward the one end of the grease-holding member for feeding grease by pushing the grease from the grease-holding member bore through the one end thereof into the bullet-holding member chamber and about a bullet therein.

Further, resilient means are fitted about the plunger leading end portion and frictionally engage the grease-holding member bore for wiping grease from the bore as grease is pushed by the plunger leading end portion toward the bullet-holding member and for preventing backflow of grease past the plunger toward the other end of the grease-holding member. More specifically, the resilient means is at least one O-ring made of a resilient yieldable material. Further, the handle at the trailing end portion of the plunger has a knurled surface.

The bullet lubricator device can also include at least one size-reducing sleeve insertable within the bullet-holding member chamber and having an opening formed therein adapted to communicate with the grease-holding member bore. The sleeve has a central chamber adapted to receive a bullet of a caliber size smaller than the given caliber which thereby adapts the bullet-holding member chamber to accommodate a bullet of a smaller caliber size than the given caliber. The bullet-holding member and the sleeve have matable means in the form of a protrusion and recess respectively formed thereon for ensuring alignment of the opening of the sleeve in communication with the grease-holding member bore upon insertion of the sleeve into the chamber of the bullet-holding member.

The bullet lubricator device can further include a pair of closures pivotally mounted, such as by respective hinges, to the respective opposite ends of the bullet-holding member. Each closure is actuatable between opened and closed positions with respect to the bullet-holding member chamber. Also, resilient means in the form of at least one O-ring can be fitted about and extend within the bore of the grease-holding member adjacent the other end thereof to frictionally engage the plunger between the leading and trailing end portions thereof for wiping foreign matter therefrom to prevent migration of foreign matter into and contamination of the bore of the grease-holding member as the plunger is moved relative thereto.

These and other advantages and attainments of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the course of the following detailed description, reference will be made to the attached drawings in which.

DETAILED DESCRIPTION OF THE INVENTION

Figure 1:
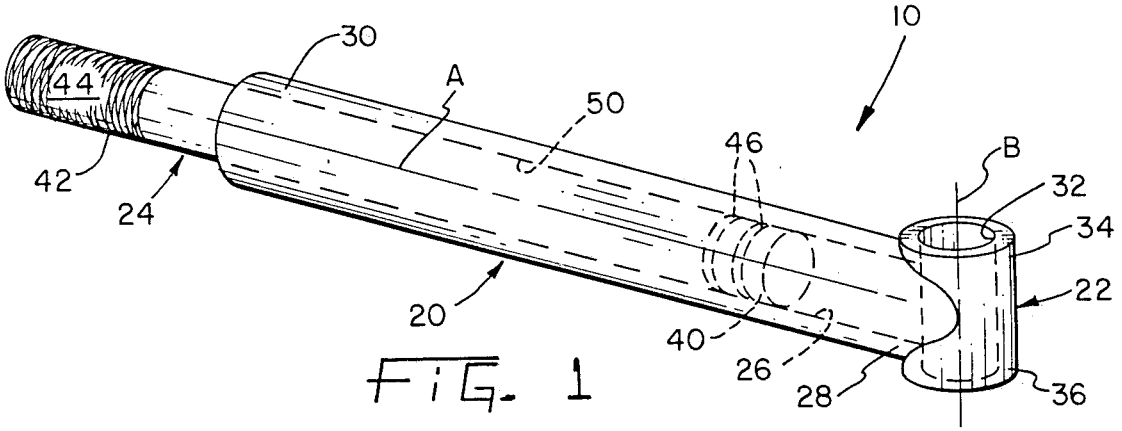
FIG. 1 is a perspective view of a first embodiment of the bullet lubricator device constructed in accordance with the present invention.

In the following description, like reference characters designate like or corresponding parts throughout the several views of the drawings. Also in the following description, it is to be understood that such terms as "forward", "left", "upwardly", and the like are words of convenience and are not to be construed as limiting terms.

Figure 2:
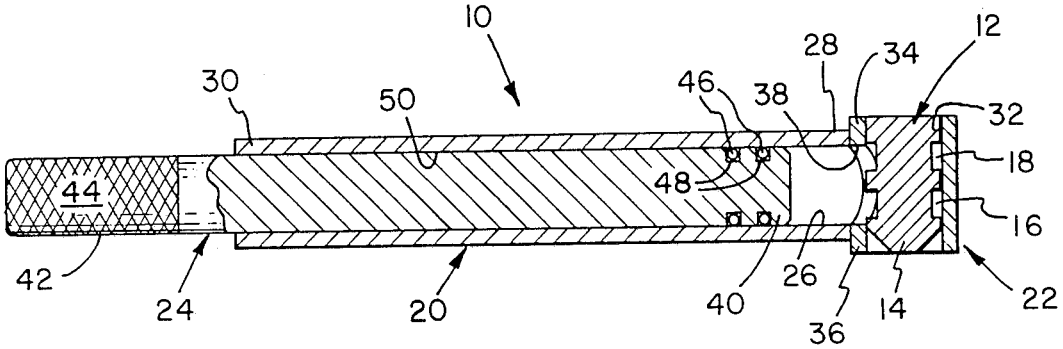
FIG. 2 is a longitudinal sectional view of the bullet lubricator device of FIG. 1, with a bullet disposed in its bullet-receiving cylinder.
Figure 5:
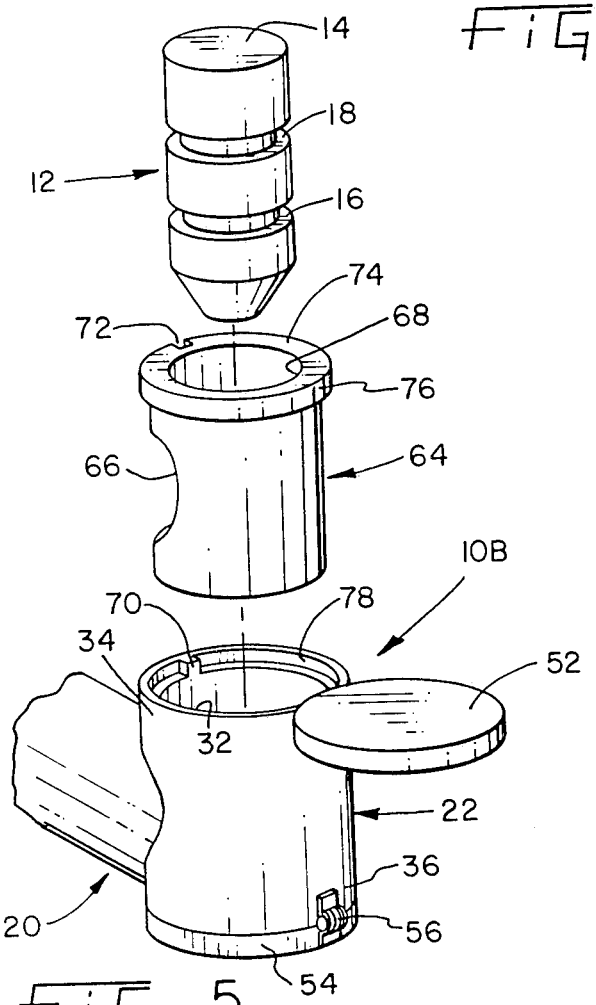
FIG. 5 is an enlarged fragmentary perspective view of the bullet lubricator device of FIG. 4, showing the bullet-receiving cylinder thereof with its top closure opened and bottom closure closed with one size-reducing sleeve and a bullet aligned thereabove.
Figure 6:
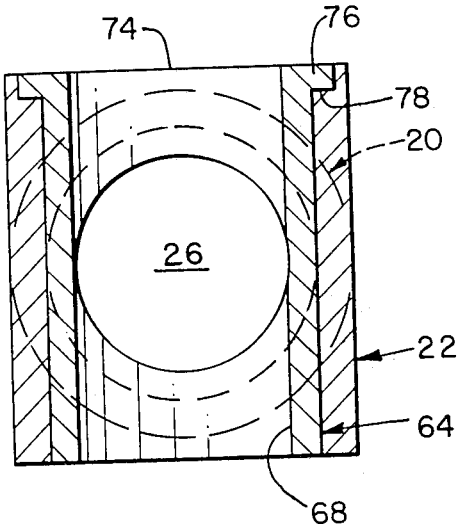
FIG. 6 is an enlarged axial sectional view taken along line 6—6 of FIG. 4, through the bullet-receiving cylinder and one size-reducing sleeve mounted therein of the bullet lubricator device of FIG. 4.
Figure 7:
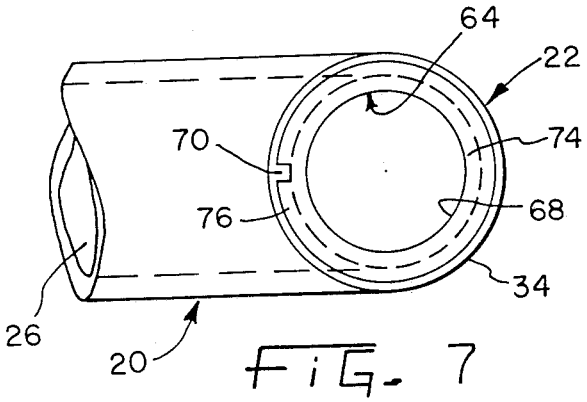
FIG. 7 is an enlarged fragmentary top plan view of the bullet lubricator device of FIG. 4, showing the bullet-receiving cylinder thereof and one size-reducing sleeve mounted therein with the top closure being omitted.

Referring now to the drawings, and particularly to FIGS. 1 and 2, there is shown a bullet lubricator device, generally designated by the numeral 10 and constituting one embodiment of the present invention. The device 10 is adapted for applying grease to a conventional bullet 12 (shown in FIGS. 2 and 5) designed for loading in the barrel of a muzzle-loading rifle (not shown). As described in the background earlier, the bullet 12 typically has a solid cylindrical body 14 of a given caliber size (for example, one of .32, .45, .50, .54 or .58 caliber) and includes annular forward and rearward endless channels or recesses 16, 18 which are provided to receive and hold a lubricating grease therein.

In its basic components, the bullet lubricator device 10 includes an elongated grease-holding cylinder 20, a bullet-holding cylinder 22 and an elongated plunger 24. More particularly, the grease-holding cylinder 20 defines an elongated cylindrical bore 26 with a central axis A and which is open at the opposite front and rear ends 28, 30 of the cylinder 20. The bullet-holding cylinder 22 defines a cylindrical chamber 32 with a longitudinal axis B and which is open at opposite upper and lower ends 34, 36 of the cylinder 22. The chamber 32 has a diameter adapting the chamber to receive therein a bullet 12 of a given one of the caliber sizes. For example, the diameter of the chamber 32 is two thousandths of an inch greater than the given caliber of the bullet 12, adapting the bullet to fit snugly within the chamber 32. The bullet-holding cylinder 22 is rigidly connected about a side opening 38 formed therein, such as by welding, to the front end 28 of the grease-holding cylinder 20, providing flow communication of the chamber 32 with the bore 26 of the grease-holding cylinder 20. The bullet-holding cylinder chamber 32 is oriented with its longitudinal axis B extending generally perpendicular to the central axis A of the grease-holding cylinder bore 26.

The elongated rod-like plunger 24 is mounted or received within the bore 26 of the grease-holding cylinder 20 and is capable of being moved through a reciprocal stroke along the central axis A of the cylinder bore 26 either in a direction away from the bullet-holding cylinder 22 for removing the plunger 24 from the cylinder bore or in a direction toward the bullet-holding cylinder 22 for pushing grease through the front end 28 of the cylinder 20. The plunger 24 has opposite leading and trailing end portions 40, 42 respectively. The leading end portion 40 of the plunger 24 is disposed within the bore 26 of the grease-holding cylinder 20 between the opposite front and rear ends 28, 30 thereof, whereas the trailing end portion 42 of the plunger 24 is disposed outside of the grease-holding cylinder bore 26 adjacent to the rear end 30 thereof.

The bore 26 of the grease-holding cylinder 20 is adapted to hold a quantity of grease therein between the leading end portion 40 of the plunger 24 and the front end 28 of the grease-holding cylinder 20. To supply grease into the cylinder bore 26 and to fill the device 10 for use, the plunger 24 is first withdrawn from the bore 26 and grease is then forced into the bore 26 in any suitable manner, such as by being squeezed from a tube (not shown). Then, the plunger 24 is inserted back into the cylinder bore 26. The cylinder bore 26 may hold sufficient grease to service thirty to thirty-five shots before reload is needed.

The plunger 24 at its trailing end portion 42 forms a handle having a knurled surface 44 which adapts it to be gripped by a user's hand for moving the plunger relative to the grease-holding cylinder 20. Such movement of the plunger 24 toward the bullet-holding cylinder 22 advances its leading end portion 40 into engagement with the grease in the bore 26 and pushes the same toward the front open end 28 of the grease-holding cylinder 20. In such manner, the grease in the bore 26 of the grease-holding cylinder 20 is metered through its front open end 28 into the bullet-holding cylinder chamber 32 and around and within the forward and rearward annular recesses 16, 18 on the body 14 of the bullet 12, as seen in FIG. 2, so as to fill the same.

Further, the plunger 24 of the bullet lubricator device 10 has resilient yieldable means to prevent backflow of grease past the plunger and out the rear end 30 of the grease-holding cylinder 20 onto the hand of the user. The resilient means takes the form of at least one, but preferably a pair of axially-spaced rubber O-rings 46 fitted about the circumference of the leading end portion 40 of the plunger 24 by being seated in a pair of axially-spaced annular circumferential grooves 48 formed therein. The O-rings 46 extend radially outward from the respective grooves 48 and frictionally engage the interior cylindrical surface 50 of the grease-holding cylinder bore 26 for wiping grease therefrom as the quantity of grease is pushed along the bore 26 by the leading end portion 40 of the plunger 24 toward the bullet-holding cylinder 22.

Figure 3:
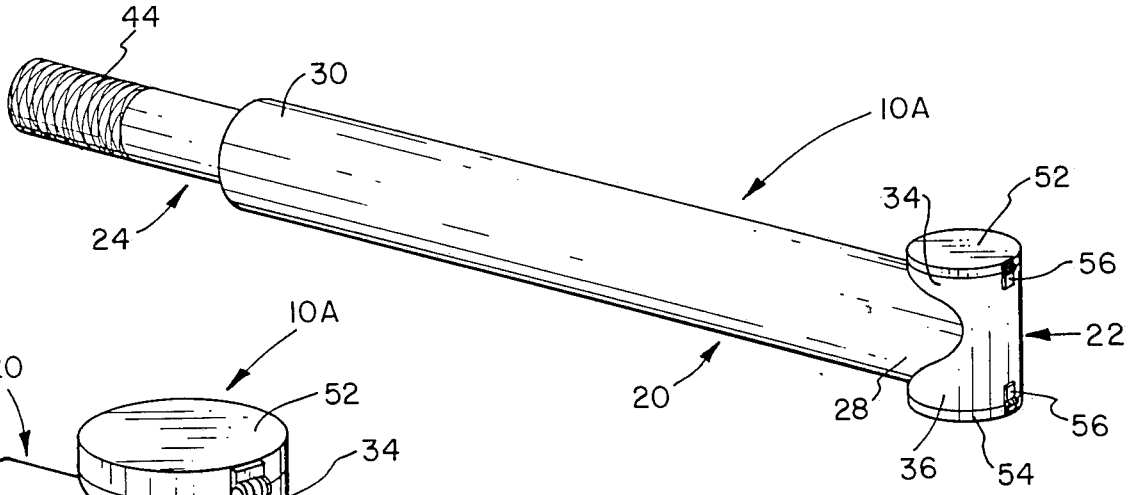
FIG. 3 is a second embodiment of the bullet lubricator device of the present invention wherein its bullet-receiving cylinder has closures hingedly mounted to opposite ends thereof.
Figure 3A:
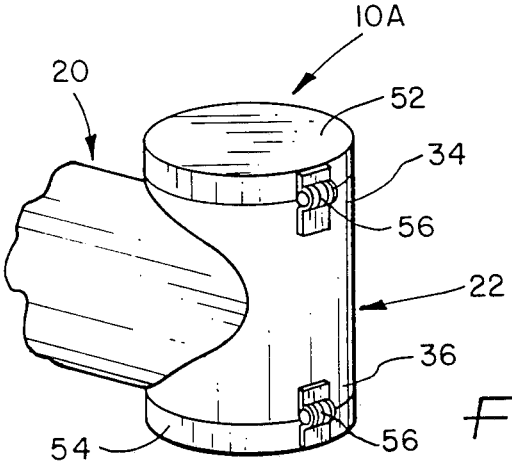
FIG. 3A is an enlarged fragmentary perspective view of the bullet lubricator device of FIG. 3, showing the bullet-receiving cylinder thereof with its hingedly-mounted closures.
Figure 8:
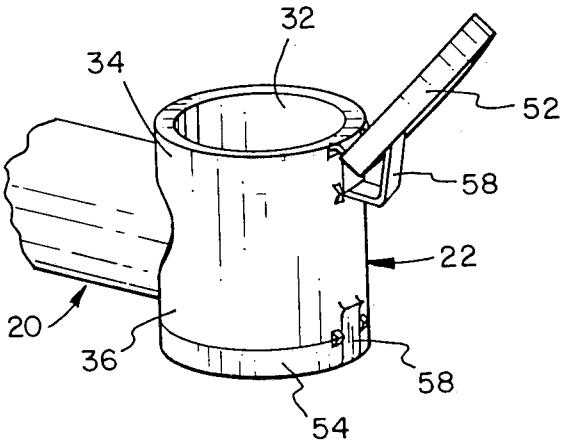
FIG. 8 is an enlarged fragmentary perspective view of the bullet lubricator device of FIG. 4, showing the bullet-receiving cylinder thereof with an alternative hinge connecting the top and bottom closures thereto.

Turning now to FIGS. 3 and 3A, a second embodiment of the bullet lubricator device 10A includes means for closing the chamber 32 of the bullet-holding cylinder 22 to prevent entry of foreign matter during periods of nonuse of the device 10, such as when the device is stored in the user's pocket. Since it is desirable to have a bullet 12 loaded in the device 10 and grease applied thereto in advance of when it is needed, the capability of keeping the chamber 32 closed will also prevent inadvertent dislodging of the bullet from the chamber. For such purpose, a pair of disc-shaped upper and lower closures 52, 54 are provided, being pivotally mounted to the respective opposite ends 34, 36 of the bullet-holding cylinder 22. Each closure 52, 54 is actuatable between opened and closed positions with respect to the bullet-holding cylinder chamber 32. In FIGS. 3, 3A, 4 and 5, the closures are each pivotally mounted to the respective bullet-holding cylinder end 34, 36 by a spring hinge 56. In FIG. 8, an alternative spring hinge is illustrated. Whereas in the other embodiments the parts can be composed of metal, in FIG. 8 the parts are composed of a suitable plastic material such that each closure 52, 54 is pivotally mounted to the respective bullet-holding cylinder end 34, 36 by an integrally-formed and resiliently bendable plastic hinge 58. In either case, the user can open the closures 52, 54 by merely using his or her thumb to flip them open while holding the device in the same hand. With the closures flipped open, the greased bullet can be easily delivered from chamber 32 to the rifle barrel by merely aligning the chamber 32 thereabove and tapping the bullet from the chamber into the rifle without contacting the bullet with the user's hands.

Figure 4:
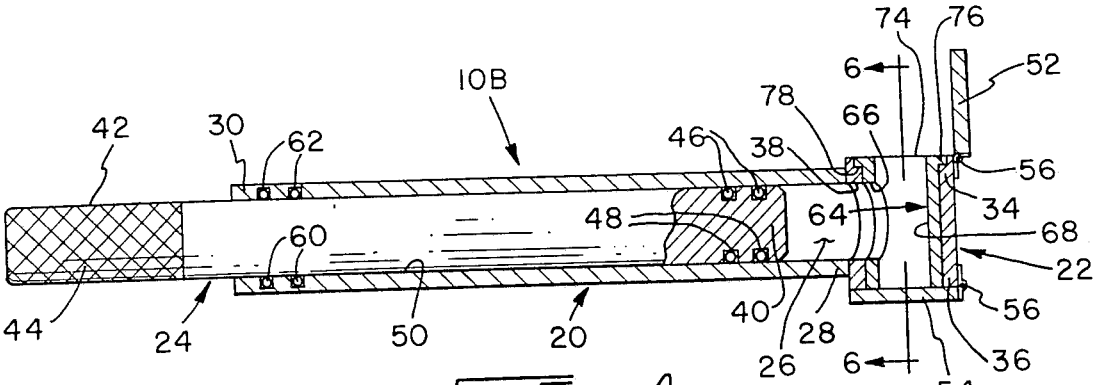
FIG. 4 is a third embodiment of the bullet lubricator device of the present invention wherein its grease-holding cylinder has a pair of O-rings mounted in its outer end portion and its bullet-holding cylinder has one of a plurality of different size-reducing sleeves mounted or received therein for accommodating different caliber bullets.

Also, in a third embodiment of the bullet lubricator device 10B shown in FIG. 4, the device 10B, in addition to the closures 52, 54, includes resilient yieldable means in the form of a pair of rubber O-rings 60 seated in a pair of annular circumferential recesses 62 defined about the interior surface 50 of the bore 26 adjacent the rear end 30 of the grease-holding cylinder 20. The O-rings 60 fitted within the recesses 62 extend radially inward within the bore 26 and frictionally engage the plunger 24 between its leading and trailing end portions 40, 42. In such manner, the O-rings 60 will wipe foreign matter from the plunger 24 so as to prevent migration of foreign matter into and contamination of the bore 26 as the plunger 24 is moved relative thereto.

Finally, as shown in FIGS. 4–7, the third embodiment of the bullet lubricator device 10B is provided with at least one size-reducing sleeve 64 insertable within the chamber 32 and having a side opening 66 formed therein adapted to communicate with the front open end of grease-holding cylinder 20. The sleeve 64 has a central chamber 68 and is open at its opposite ends, adapting it to receive a bullet of a caliber size smaller than the given caliber of the bullet-holding cylinder 22. In such manner, a bullet of smaller caliber size can be accommodated in the chamber 32. The bullet-holding cylinder 22 and the sleeve 64 have matable keying means in the form of a protrusion 70 and a recess 72 formed respectively on upper ends 34, 74 thereof for ensuring alignment of the sleeve side opening 66 in communication with grease-holding cylinder front open end 28 upon insertion of the sleeve 64 into the bullet-holding cylinder chamber 32. The sleeve 64 also at its upper end 74 has an outwardly-protruding lip 76 which nests in an annular recess 78 defined in the upper end 34 of the cylinder 22. The sleeve lip 76 has the notch or recess 72 defined therein.

It should be readily apparent that multiple sleeves 64 can be provided having different internal diameters to adapt the device to accommodate a range of bullet caliber sizes.

It is thought that the bullet lubricator device of the present invention and many of its attendant advantages will be understood from the foregoing description and it will be apparent that various changes may be made in the form, construction and arrangement of the parts and steps thereof without departing from the spirit and scope of the invention or sacrificing all of its material advantages, the form hereinbefore described being merely exemplary embodiments thereof.

What is claimed is:

1. A bullet lubricator device, comprising:

an elongated grease-holding cylinder having an elongated bore with a central axis and being open at opposite ends thereof;

a bullet-holding cylinder being connected in flow communication with one of said opposite ends of said grease-holding cylinder, said bullet-holding cylinder defining a chamber being open at opposite ends thereof and adapted to receive a bullet of a given caliber therein, said chamber having a longitudinal axis extending generally perpendicular to said central axis of said bore of said grease-holding cylinder;

an elongated plunger received within said bore of said grease-holding cylinder and capable of reciprocal movement along said central axis thereof, said plunger having opposite leading and trailing end portions, said leading end portion being disposed within said bore of said grease-holding cylinder between said opposite ends thereof and said trailing end portion thereof being disposed outside of said bore of said grease-holding cylinder adjacent to the other of said opposite ends thereof;

said grease-holding cylinder being adapted to hold a quantity of grease therein between said leading end portion of said plunger and said one of said opposite ends of said grease-holding cylinder;

said plunger at said trailing end portion thereof forming a handle adapted to be gripped by a user's hand for moving said plunger relative to said grease-holding cylinder to advance said leading end portion of said plunger toward said one end of said grease-holding cylinder and said bullet-holding cylinder connected in communication therewith for pushing grease from said grease-holding cylinder bore through said one end thereof into said bullet-holding cylinder chamber and about a bullet therein; and, resilient means fitted about and extending within said bore of said grease-holding cylinder adjacent said other end thereof and frictionally engaged with said plunger between said leading and trailing end portions thereof for wiping foreign matter therefrom to prevent migration of foreign matter into and contamination of said bore of said grease-holding cylinder as said plunger is moved relative thereto.

2. The bullet lubricator device as recited in claim 1, further comprising:

resilient means fitted about the circumference of said leading end portion of said plunger and frictionally engaged with the interior surface of said grease-holding cylinder for wiping grease from said surface as grease is pushed by said plunger leading end portion toward said bullet-holding cylinder chamber to prevent backflow of grease past said plunger toward said other end of said grease-holding cylinder bore.

3. The bullet lubricator device as recited in claim 2, wherein said resilient means is at least one O-ring made of a resilient yieldable material.

4. The bullet lubricator device as recited in claim 1, wherein handle at said trailing end portion of said plunger has a knurled surface.

5. The bullet lubricator deice as recited in claim 1, wherein said resilient means is at least one O-ring made of a resilient yieldable material.

6. A bullet lubricator device, comprising:

an elongated grease-holding cylinder having an elongated bore with a central axis and being open at opposite ends thereof;

a bullet-holding cylinder being connected in flow communication with one of said opposite ends of said grease-holding cylinder, said bullet-holding cylinder defining a chamber being open at opposite ends thereof and adapted to receive a bullet of a given caliber therein, said chamber having a longitudinal axis extending generally perpendicular to said central axis of said bore of said grease-holding cylinder;

an elongated plunger received within said bore of said grease-holding cylinder and capable of reciprocal movement along said central axis thereof, said plunger having opposite leading and trailing end portions, said leading end portion being disposed within said bore of said grease-holding cylinder between said opposite ends thereof and said trailing end portion thereof being disposed outside of said bore of said grease-holding cylinder adjacent to the other of said opposite ends thereof;

said grease-holding cylinder being adapted to hold a quantity of grease therein between said leading end portion of said plunger and said one of said opposite ends of said grease-holding cylinder;

said plunger at said trailing end portion thereof forming a handle adapted to be gripped by a user's hand for moving said plunger relative to said grease-holding cylinder to advance said leading end portion of said plunger toward said one end of said grease-holding cylinder and said bullet-holding cylinder connected in communication therewith for pushing grease from said grease-holding cylinder bore through said one end thereof into said bullet-holding cylinder chamber and about a bullet therein; and, at least on size-reducing sleeve insertable within said bullet-holding cylinder chamber and having an opening formed therein adapted to communicate with said bore at said one end of said grease-holding cylinder, said sleeve having a central chamber adapted to receive a bullet of a caliber size smaller than said given caliber thereby adapting said bullet-holding cylinder chamber to accommodate a bullet of smaller caliber size than said given caliber.

7. The bullet lubricator device as recited in claim 6, wherein said bullet-holding cylinder and said sleeve have matable means formed thereon for ensuring alignment of said opening of said sleeve in communication with said bore at said one end of said grease-holding cylinder upon insertion of said sleeve into said chamber of said bullet-holding cylinder.

8. The bullet lubricator device as recited in claim 7, wherein said matable means includes:

a protrusion formed on said bullet-holding cylinder; and a recess formed in said sleeve being sized to receive said protrusion upon insertion of said sleeve within said chamber of said bullet-holding cylinder with said opening of said sleeve aligned in communication with said bore at said one end of said grease-holding cylinder.

9. The bullet lubricator device as recited in claim 8, wherein said protrusion is formed at one end of said bullet-holding cylinder and said recess is formed at a corresponding end of said sleeve.

10. A bullet lubricator device, comprising:

an elongated grease-holding cylinder having an elongated bore with a central axis and being open at opposite ends thereof;

a bullet-holding cylinder being connected in flow communication with one of said opposite ends of said grease-holding cylinder, said bullet-holding cylinder defining a chamber being open at opposite ends thereof and adapted to receive a bullet of a given caliber therein, said chamber having a longitudinal axis extending generally perpendicular to said central axis of said bore of said grease-holding cylinder;

an elongated plunger received within said bore of said grease-holding cylinder and capable of reciprocal movement along said central axis thereof, said plunger having opposite leading and trailing end portions, said leading end portion being disposed within said bore of said grease-holding cylinder between said opposite ends thereof and said trailing end portion thereof being disposed outside of said bore of said grease-holding cylinder adjacent to the other of said opposite ends thereof;

said grease-holding cylinder being adapted to hold a quantity of grease therein between said leading end portion of said plunger and said one of said opposite ends of said grease-holding cylinder;

said plunger at said trailing end portion thereof forming a handle adapted to be gripped by a user's hand for moving said plunger relative to said grease-holding cylinder to advance said leading end portion of said plunger toward said one end of said grease-holding cylinder and said bullet-holding cylinder connected in communication therewith for pushing grease from said grease-holding cylinder bore through said one end thereof into said bullet-holding cylinder chamber and about a bullet therein; and, a pair of closures pivotally mounted to said respective opposite ends of said bullet-holding cylinder, each closure being actuatable between opened and closed positions with respect to said bullet-holding cylinder chamber.

11. The bullet lubricator device as recited in claim 10, wherein said each closure is pivotally mounted to its respective bullet-holding cylinder end by a spring hinge.

12. The bullet lubricator device as recited in claim 10, wherein said bullet-holding cylinder and said each closure are made of a plastic material and said each closure is pivotally mounted to said bullet-holding cylinder end by an integrally-formed and resiliently bendable plastic hinge.

13. A bullet lubricator device, comprising:

a grease-holding tubular member defining a bore open at opposite ends of said member;

a bullet-holding member being connected in flow communication with one of said opposite ends of said grease-holding member and defining a chamber open at opposite ends of said member and adapted to receive a bullet of a given caliber therein;

a plunger received within said grease-holding member bore and capable of reciprocal movement therein, said plunger having opposite leading and trailing end portions, said leading end portion thereof being disposed within said grease-holding member bore between said opposite ends thereof and said trailing end portion thereof being disposed outside of said bore adjacent to the other of said opposite ends thereof;

said grease-holding member bore being adapted to hold a quantity of grease therein between said leading end portion of said plunger and said one of said opposite ends of said grease-holding member;

said plunger trailing end portion forming a handle adapted to be gripped by a user's hand for moving said plunger relative to said grease-holding member to advance said leading end portion of said plunger toward said one end of said grease-holding member for pushing grease from said grease-holding member bore through said one end thereof into said bullet-holding member chamber and about a bullet therein;

resilient means fitted about said plunger leading end portion and frictionally engaged with said grease-holding member bore for wiping grease from said bore as grease is pushed by said plunger leading end portion toward said bullet-holding member and to prevent backflow of grease toward said plunger trailing end; and, a pair of closures pivotally mounted to said respective opposite ends of said bullet-holding member, each closure being actuatable between opened and closed positions with respect to said bullet-holding member chamber.

14. The bullet lubricator device as recited in claim 13, wherein said each closure is pivotally mounted to its respective bullet-holding member end by a spring hinge.

15. The bullet lubricator device as recited in claim 13, wherein said bullet-holding member and said each closure are made of a plastic material and said each closure is pivotally mounted to said bullet-holding member and by an integrally-formed and resiliently bendable plastic hinge.

16. The bullet lubricator device as recited in claim 13, wherein said resilient means is at least one O-ring made of a resilient yieldable material.

17. The bullet lubricator device as recited in claim 13, wherein said handle at said trailing end portion of said plunger has a knurled surface.

18. A bullet lubricator device, comprising:

a grease-holding tubular member defining a bore open at opposite ends of said member;

a bullet-holding member being connected in flow communication with one of said opposite ends of said grease-holding member and defining a chamber open at opposite ends of said member and adapted to receive a bullet of a given caliber therein;

a plunger received within said grease-holding member bore and capable of reciprocal movement therein, said plunger having opposite leading and trailing end portions, said leading end portion thereof being disposed within said grease-holding member bore between said opposite ends thereof and said trailing end portion thereof being disposed outside of said bore adjacent to the other of said opposite ends thereof;

said grease-holding member bore being adapted to hold a quantity of grease therein between said leading end portion of said plunger and said one of said opposite ends of said grease-holding member;

said plunger trailing end portion forming a handle adapted to be gripped by a user's hand for moving said plunger relative to said grease-holding member to advance said leading end portion of said plunger toward said one end of said grease-holding member for pushing grease from said grease-holding member bore through said one end thereof into said bullet-holding member chamber and about a bullet therein;

resilient means fitted about said plunger leading end portion and frictionally engaged with said grease-holding member bore for wiping grease from said bore as grease is pushed by said plunger leading end portion toward said bullet-holding member and to prevent backflow of grease toward said plunger trailing end; and, at least one size-reducing sleeve insertable within said bullet-holding member chamber and having an opening formed therein adapted to communicate with said grease-holding member bore, said sleeve having a central chamber adapted to receive a bullet of a caliber size smaller than said given caliber which thereby adapts said bullet-holding member chamber to accommodate a bullet of smaller caliber size than said given caliber.

19. The bullet lubricator device as recited in claim 18, wherein said bullet-holding member and said sleeve have matable means formed thereon for ensuring alignment of said opening of said sleeve in communication with said grease-holding member bore upon insertion of said sleeve into said chamber of said bullet-holding member.

20. The bullet lubricator device as recited in claim 19, wherein said matable means includes:

a protrusion formed on said bullet-holding member, and a recess formed in said sleeve being sized to receive said protrusion upon insertion of said sleeve within said chamber of said bullet-holding member with said opening of said sleeve aligned in communication with said grease-holding member bore.

21. The bullet lubricator device as recited in claim 20, wherein said protrusion is formed at one end of said bullet-holding member and said recess is formed at a corresponding end of said sleeve.

22. A bullet lubricator device, comprising:

a grease-holding tubular member defining a bore open at opposite ends of said member;

a bullet-holding member being connected in flow communication with one of said opposite ends of said grease-holding member and defining a chamber open at opposite ends of said member and adapted to receive a bullet of a given caliber therein;

a plunger received within said grease-holding member bore and capable of reciprocal movement therein, said plunger having opposite leading and trailing end portions, said leading end portion thereof being disposed within said grease-holding member bore between said opposite ends thereof and said trailing end portion thereof being disposed outside of said bore adjacent to the other of said opposite ends thereof;

said grease-holding member bore being adapted to hold a quantity of grease therein between said leading end portion of said plunger and said one of said opposite ends of said grease-holding member;

said plunger trailing end portion forming a handle adapted to be gripped by a user's hand for moving said plunger relative to said grease-holding member to advance said leading end portion of said plunger toward said one end of said grease-holding member for pushing grease from said grease-holding member bore through said one end thereof into said bullet-holding member chamber and about a bullet therein;

resilient means fitted about said plunger leading end portion and frictionally engaged with said grease-holding member bore for wiping grease from said bore as grease is pushed by said plunger leading end portion toward said bullet-holding member and to prevent backflow of grease toward said plunger trailing end; and, resilient means fitted about and extending within said bore of said grease-holding member adjacent said other end thereof and frictionally engaged with said plunger between said leading and trailing end portions thereof for wiping foreign matter therefrom to prevent migration of foreign matter into and contamination or said bore of said grease-holding member as said plunger is moved relative thereto.

23. The bullet lubricator device as recited in claim 22, wherein said resilient means is at least one O-ring made of a resilient yieldable material.

* * * * *